US005758579A

United States Patent [19]

Marmin et al.

[11] Patent Number: 5,758,579

[45] Date of Patent: Jun. 2, 1998

[54] DEVICE FOR REPLACING PRINTING PLATES IN ROTARY PRINTING PRESSES

[75] Inventors: Jean-Claude Marmin, Estrees-Saint-Denis; Jacky Planas, Creil, both of France

[73] Assignee: Heidelberger DruckmaschinenAG, Heidelberg, France

[21] Appl. No.: 423,253

[22] Filed: Apr. 17, 1995

[30] Foreign Application Priority Data

Nov. 15, 1994 [FR] France ..... 94 04608

[51] Int. Cl.[6] ..... B41L 3/02

[52] U.S. Cl. ..... 101/486; 101/415.1; 101/477

[58] Field of Search ..... 101/477, 415.1, 101/378, 132, 212, 216, 485, 486

[56] References Cited

U.S. PATENT DOCUMENTS

| | | | |
|---|---|---|---|
| 5,443,006 | 8/1995 | Beisel et al. | 101/477 |
| 5,479,858 | 1/1996 | Beisel et al. | 101/477 |
| 5,483,892 | 1/1996 | Stiel | 101/477 |
| 5,495,805 | 3/1996 | Beisel et al. | 101/477 |

FOREIGN PATENT DOCUMENTS

| | | |
|---|---|---|
| 0 431 575 | 6/1991 | European Pat. Off. . |
| 435 575 | 6/1991 | European Pat. Off. . |
| 0 435 410 | 7/1991 | European Pat. Off. . |
| 0 435 413 | 7/1991 | European Pat. Off. . |
| 435 413 | 7/1991 | European Pat. Off. . |
| 89/03771 | 5/1989 | WIPO . |

*Primary Examiner*—Eugene H. Eickholt
*Attorney, Agent, or Firm*—Kenyon & Kenyon

[57] ABSTRACT

The present invention relates to a device for replacing printing plates in rotary printing presses, particularly in web-fed rotary printing presses for printing both sides of a material web. The printing presses have at least one printing unit which has a cylinder having a clamping device within a cylinder gap for clamping the ends of a printing plate wound around the surface of the cylinder. The plate cylinder has a removal device for removing the printing plates released by the plate cylinder, as well as an infeed device for new printing plates to be fastened on the plate cylinder. The invention includes a plate cylinder of a lower printing unit with associated pivotable plates to be fed, as well as pivotable holding devices for the printing plates to be removed from the plate cylinder. The feed and the holding devices support the printing plates in a hanging position.

25 Claims, 10 Drawing Sheets

28'
71
72
5
1
3
53
52
27
51
51'
11
28
30
61
B
50
58
54
55
55'
59
59'
60
57
56
6
A

DEVICE FOR REPLACING PRINTING PLATES IN ROTARY PRINTING PRESSES

BACKGROUND OF THE INVENTION

1. Field of the Invention

The present invention relates to a device for replacing printing plates in rotary printing presses, particularly in web-fed rotary printing presses which print both sides of a material web. Printing presses using the present invention have at least one printing unit with a cylinder having a clamping device within a cylinder gap for clamping the ends of a printing plate wound around the surface of the cylinder. The present invention includes a removal device for removing the printing plates released by the plate cylinder as well as a feed device associated with the cylinder for mounting new printing plates.

2. Description of the Related Art

European Patent Application No. 0 431 575 discloses a plate feed device for sheet-fed rotary printing presses with printing units assembled in a row. A cassette for receiving the printing plates is pivotally mounted to the back part of a printing unit. In order to move the cassette in its rest position, the cassette is pivoted against the back wall of a printing unit, and in its operating position the cassette is engaged with the surface of a plate cylinder by a pneumatic cylinder. When the cassette is in its disengaged or rest position, it is disadvantageous in that it is not possible for the operator to have access to the free space between the individual printing units. The front part of the cassette to be engaged with the outer cylindrical surface of a plate cylinder has press-down rollers ensuring that through the exertion of pressure on the printing plate the cassette is correctly wound around the plate cylinder during the plate-feeding process. These pivotally mounted rollers engaged with the plate cylinder, however, constitute an extra mechanism, at an extra cost, which should be avoided.

European Patent Application Nos. 0 435 413 and 0 435 410 also disclose printing plate replacement devices for rotary printing presses, particularly sheet-fed rotary printing presses. These devices also use pivotable cassettes engageable with the outer cylindrical surface of a plate cylinder. The cassette holds the printing plate removed from the plate cylinder as well as the new printing plate to be fed onto the plate cylinder. One design-related feature of this cassette is that the printing plates held therein are fed onto the outer cylindrical surface of the plate cylinder from above, supported by gravity.

SUMMARY OF THE INVENTION

In web-fed rotary printing presses—for example, printing units arranged in superposition—feeding of printing plates from above into a lower printing unit is impossible, as the material web extending across the free space between two adjacent printing units would have to be severed. The web would have to be drawn in anew which would result in enormous waste of web material and unduly long machine stand-still times. Therefore, a pivotable cassette according to the teaching of the above-described prior art is not feasible for engagement with a lower printing unit.

In view of the disadvantages made apparent in the state of the art, it is the object of the present invention to provide a printing plate replacement device which permits printing plate replacement on a lower printing unit of a printing press without severing the material web.

According to the present invention, this object is achieved whereby, adjacent to a lower printing unit of a printing press, there are disposed holding devices which bring a section of a printing plate to be fed to the plate cylinder in tangential engagement with the outer cylindrical surface of the plate cylinder.

With this solution according to the present invention, advantage is taken of the elasticity of the printing plate to be fed. Consequently, a front region of the printing plate to be fed is substantially oriented in parallel with a tangent line to the curvature of the plate cylinder, causing a bending of the printing plate front region in a manner that, as the printing plate approaches the gap of the plate cylinder, its front edge dips into the cylinder gap, thereby bringing the new printing plate in place on the plate cylinder. The printing plate to be fed is received while in a vertical, space-saving position, so that accessibility to the free space between the printing units is not limited. Furthermore, the material web extending between two respective printing units can remain intact, since it is not impaired by the printing plate to be fed to the lower printing unit.

According to another advantageous feature of the present invention, the holding devices are disposed on a support plane which is pivotable around a pivot axis. The pivot axis extends parallel with the axis of rotation of the plate cylinder. The holding devices on the support plane are disposed so as to hold evenly the printing plate to be fed. Furthermore, the holding devices on the pivotable support plane can be advantageously integrated into a common vacuum system. This vacuum system remains actuated during tangential orientation of the pivotable holding means to the surface of the plate cylinder while a printing plate is fed. In this way, the rear part of the new printing plate to be fed hanging in the free space between printing units is held by the holding devices while the front edge of the new printing plate has dipped into the gap of the plate cylinder as a result of its tangential orientation, whereby a certain bias is created in the new printing plate.

The support plane, being pivotable through an actuating unit, is moved back into its start position after the rear part of the printing plate to be fed has passed, in order to enable the passage of the angled rear part of the printing plate.

According to another feature of the present invention, the feeding device includes holding devices for temporarily supporting the front edge of the printing plate to be fed.

Furthermore, the holding devices temporarily supporting the printing plate front edge are movable in a horizonal direction by actuating units mounted in the machine walls and connected with the holding devices. These holding devices, for temporarily supporting the printing plate front edge, are simple receiving pins, and are a favorable alternative of simple design and are inexpensive to make. In order to provide for correct alignment of a new printing plate to be fastened on the plate cylinder, a holding device temporarily supporting the printing plate edge includes a stop which aligns the printing plate laterally.

With the plate cylinder of a lower printing unit there is associated an infeed device and a removal device. The removal device includes fixedly arranged stop devices and pivotable holding devices. The pivotable holding devices can be pivoted from a position where they are in contact with the outer cylindrical surface of the plate cylinder to a position where they are in contact with the stop devices. This pivoting movement is performed through an actuating unit which is movably mounted in a side wall of a printing unit and loaded with a pressure medium. The stop devices, against which the rear end of a printing plate abuts when removed from the circumference of the plate cylinder, are designed as stationary stops. The side of the stops facing the printing plate to be removed is made of a friction-reducing material, so that the printing surface of the printing plates experiences gentle treatment. In order to ensure that the rear end of printing plate abuts against the stop devices, the stop devices are positioned in a manner that they extend over the equatorial arc of the plate cylinder. As a result, the released rear end of the printing plate to be replaced will abut in any event.

BRIEF DESCRIPTION OF THE DRAWINGS

These and other characteristic features of the invention will be explained in detail in the following description which will be best understood when read in connection with accompanying drawings, in which.

DETAILED DESCRIPTION OF THE INVENTION

Figure 1:
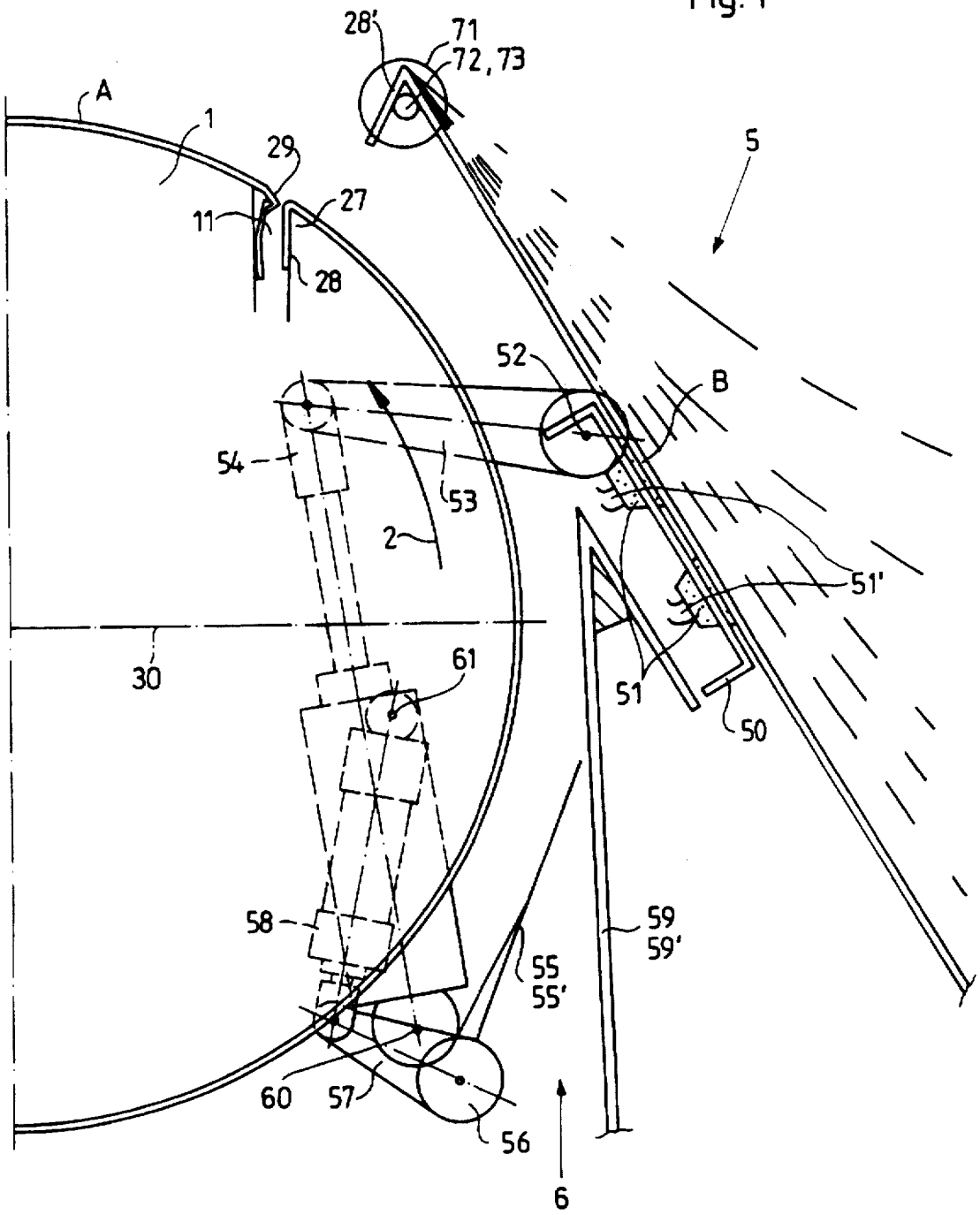
FIG. 1 is side view of the periphery of the plate cylinder of a lower printing unit.

FIG. 1 shows a side view of the periphery of plate cylinder 1 with a printing plate A to be removed being fastened thereon. A printing plate front edge 28 as well as a printing plate rear edge 29 are held in a cylinder gap 11 of the plate cylinder 1. The printing plate rear edge is locked by devices of a clamping member. The outer cylindrical surface of the plate cylinder 1 is associated with an infeed device 5, as well as with a removal device 6 situated below the infeed device 5. The curved lines above the new printing plate B indicate the positions which the printing plate B can take as it is suspended on receiving pins 72 and 73.

The direction of rotation of the plate cylinder 1 is indicated by an arrow 2 in FIG. 1 pointing in a counterclockwise direction. The actuating units 54 and 58 are mounted on supports 60 and 61 in a side part not illustrated in FIG. 1.

A lever 53 is turned around a pivot axis 52 by an actuating unit 54 supported in a side part. The turning movement of lever 53 around axis 52 moves a support plane 50 around pivot axis 52. On the support plane 50 there are provided multiple pneumatic holding devices 51 which are connected with an central vacuum system 51'. The vacuum system 51' is indicated schematically by lines.

The support 61 holds an actuating unit 58 which acts on a lever 57 turntable around a pivot axis 56. To the pivot axis 56 there are attached several uniformly spaced pivot cams 55. The pivot cams 55 are movable in the space between the outer surface of the plate cylinder 1 and the front side of the printing plate stops 59, 59'. The printing plate stops 59, 59' are fixedly mounted, and the side of printing plates stops 59,59' facing the printing surface of the printing plate A is provided with a friction-reducing layer, so that with sliding down of the printing plate A no damage is done to its printing surface.

Figure 2:
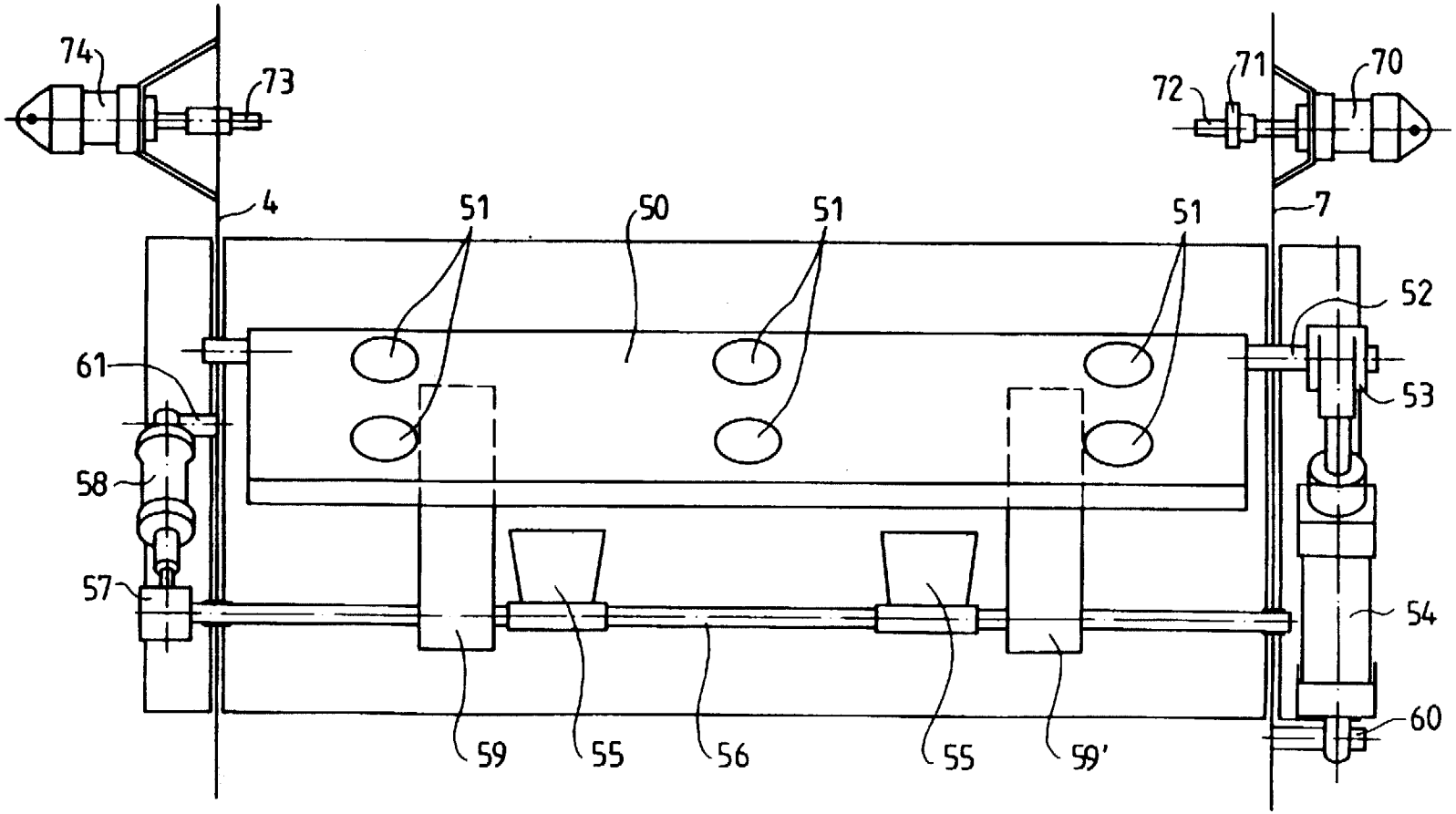
FIG. 2 is a front view of devices according to the present invention.

FIG. 2 shows a front view of devices according to the present invention. Actuating units 70 and 74 are respectively attached to side parts 4 and 7 of the printing unit. The actuating units 70 and 74 of the printing unit act on the receiving pins 72 and 73, the receiving pin 72 having a lateral stop 71. At this lateral stop 71 a new printing plate B to be fed to the outer cylindrical surface of the plate cylinder 1 is aligned. In rotary printing presses with plate cylinders 1 receiving multiple printing plates side by side there can, of course, be provided multiple printing plate replacement devices.

Also illustrated in FIG. 2 is the pivotable support plane 50, which has multiple pneumatic holding devices 51 arranged in equal distribution. Pneumatic holding devices 51 are connected a common vacuum system, so that a printing plate to be fixed can be sucked to the holding devices uniformly. The printing plate stops 59 and 59' can be seen below the pivotable support plane 50, which partially covers them. A pivot 56, which is also mounted in the side part 4 and 7 of the printing unit, has pivot cam 55, 55' attached to it, and the front edge 28 of a printing plate A to be removed from the plate cylinder 1 is supported by the pivot cam 55, 55'. As already explained in connection with FIG. 1, respective actuating units 54 and 58 are movably mounted on supports 60 and 61 in the printing unit side parts 4 and 7.

Figure 3:
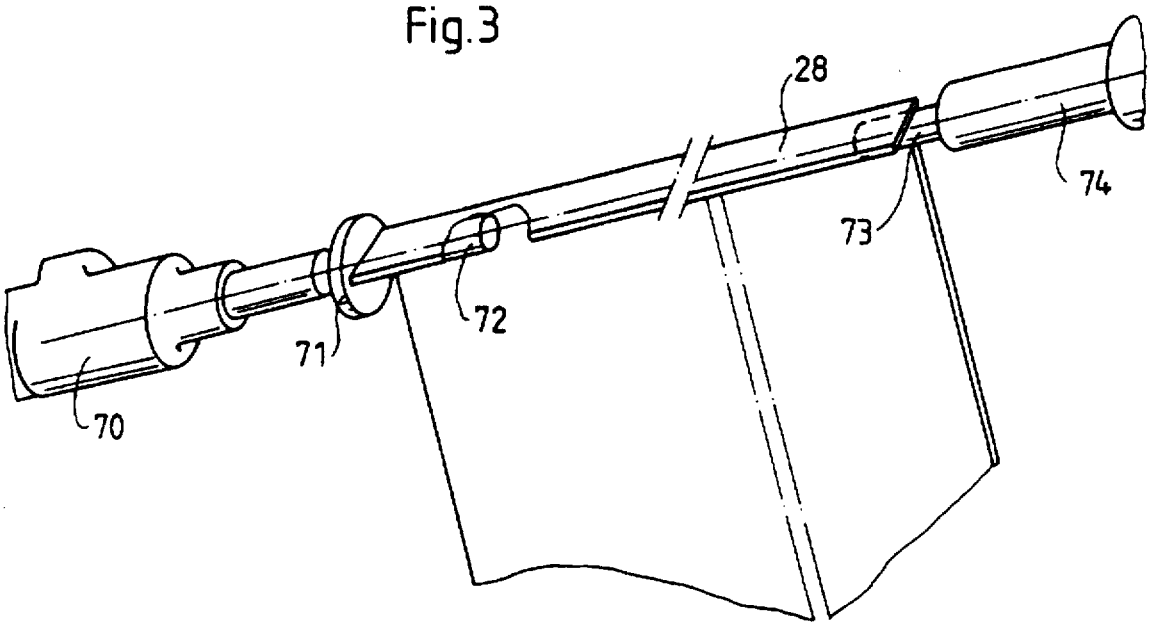
FIG. 3 is a detailed view of the holding devices temporarily supporting the printing plate front edge.

FIG. 3 is a detailed view of the holding devices 72 and 73 supporting a printing plate front edge 28. As is visible in this illustration, the receiving pins 72 and 73 are held in the actuating units 70 and 74. The actuating units 70 and 74 could be pneumatically or electromagnetically operated units.

Figure 4:
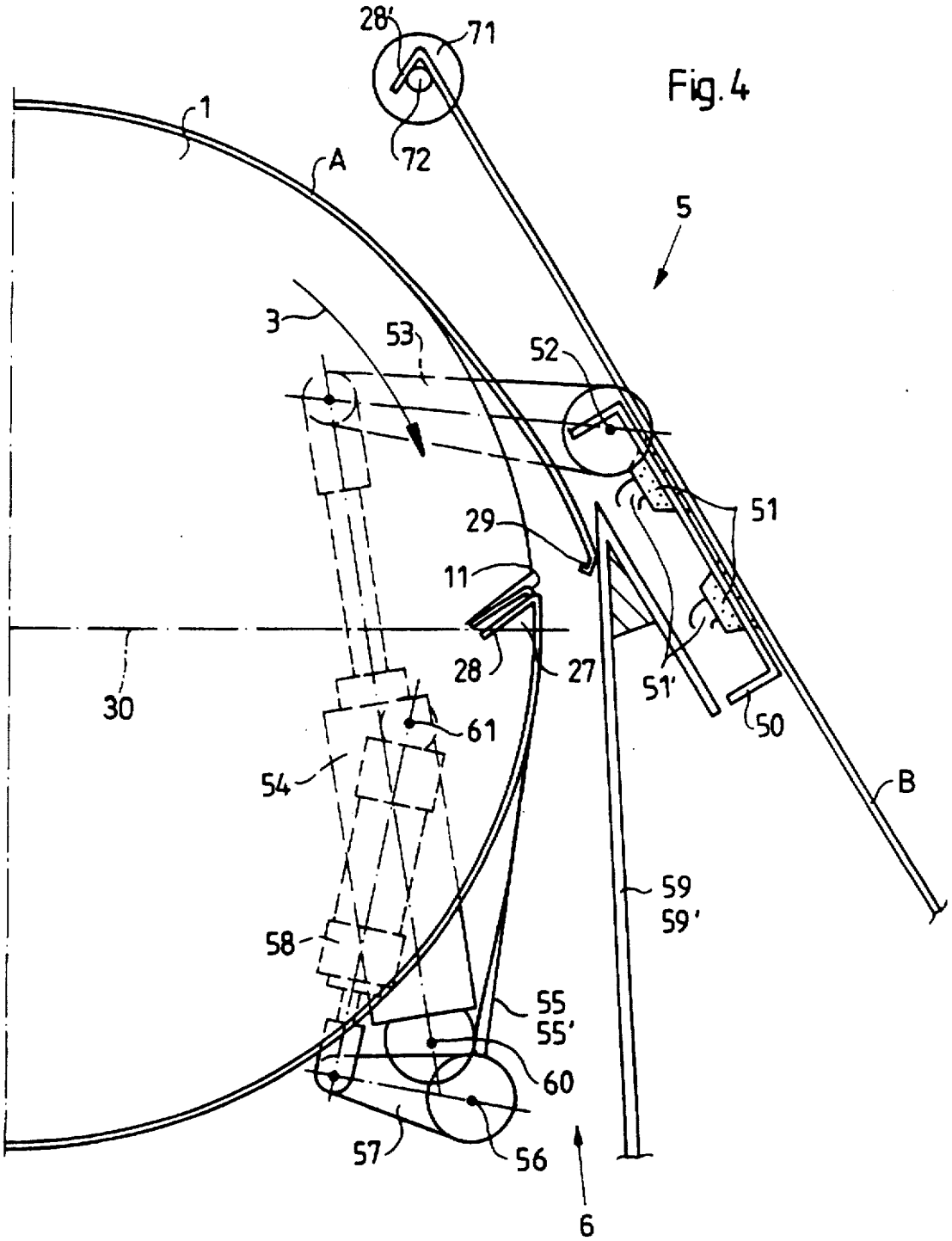
FIG. 4 is an illustration of the beginning of the removal process of printing plate fastened on the outer cylindrical surface of a plate cylinder.

As illustrated in FIG. 4, the front edge 28' of the new printing plate B is temporarily supported by a receiving pin 72 having a lateral stop 71. The front region of the new printing plate B rests on the holding devices 51 which are evenly distributed on a pivotable support plane 50. The position of the support plane 50 shown in FIG. 4 is a rest position in relation to its pivot path around the pivot axis 52. Consequently, the lever 53 and a piston-type actuating unit 54, which cooperates with the lever 53, are at rest in FIG. 4.

The rear edge 29 of printing plate A to be removed, which is located on the outer cylindrical surface of the plate cylinder 1, is released by the clamping device in the cylinder gap 11 of the plate cylinder 1. The clamping devices are not illustrated herein, as they is known in the art. The printing plate rear edge 29 released from the cylinder gap 11 abuts against the stationary printing plate stops 59 and 59'. The printing plate stops 59 and 59' are each provided with a friction-reducing layer so that the printing plate surfaces contacting them are not damaged.

With rotation of the plate cylinder 1 in the clockwise direction—indicated by numeral 3—the pivot cams 55, 55', movable around the pivot axis 56, move under the surface of the printing plate A to be removed. Thereafter, the printing plate A is literally peeled off from the outer cylindrical surface of the plate cylinder 1. The pivot cams 55 and 55' are held in their respective position by actuating unit 58. The actuating unit 58 and the pivot axis 56 are connected by a lever 57.

Figure 5:
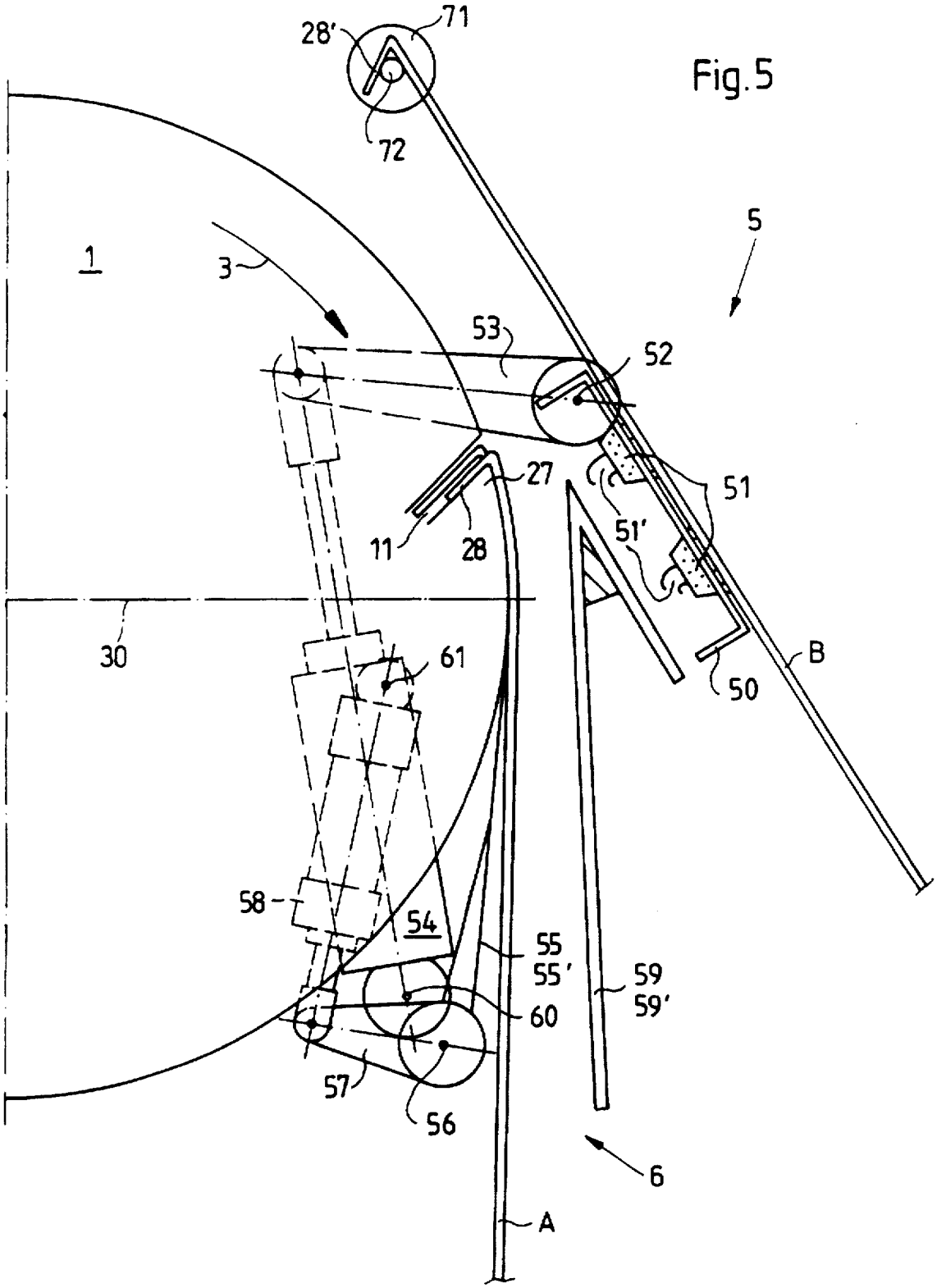
FIG. 5 is an illustration of placement of the front region of a printing plate to be removed on a pivotable holding device.

FIG. 5 illustrates a rotational movement of the plate cylinder of almost 360° from FIG. 4. This rotational movement of the plate cylinder 1 is in the clockwise direction 3. The front edge 28' of the new printing plate B still is held fixedly by the receiving pins 72; the pneumatic hold devices 51 provided on the support plane 50 are not yet supplied with vacuum; the new printing plate B rests in this position solely through its own weight.

As can be seen in FIG. 5, the pivot cams 55, 55' have moved under the printing plate A to be removed so that with further rotational movement of the plate cylinder 1 in clockwise direction 3, the printing plate A is lifted out of the cylinder gap 11, including its front edge 28. In this state the printing areas of the printing plate A do not come in contact with the printing plate stops 59, 59'. During rotational movement of the plate cylinder 1 with the printing plate A supported by the pivot cams 55, 55', the pivot axis 56, the lever 57 and the actuating unit 58 remain in the position shown in FIG. 5. The rotational movement of the plate cylinder 1 in the direction of the arrow 3 takes place at a creeping speed (e.g., 1–2 revolutions per minute).

Figure 6:
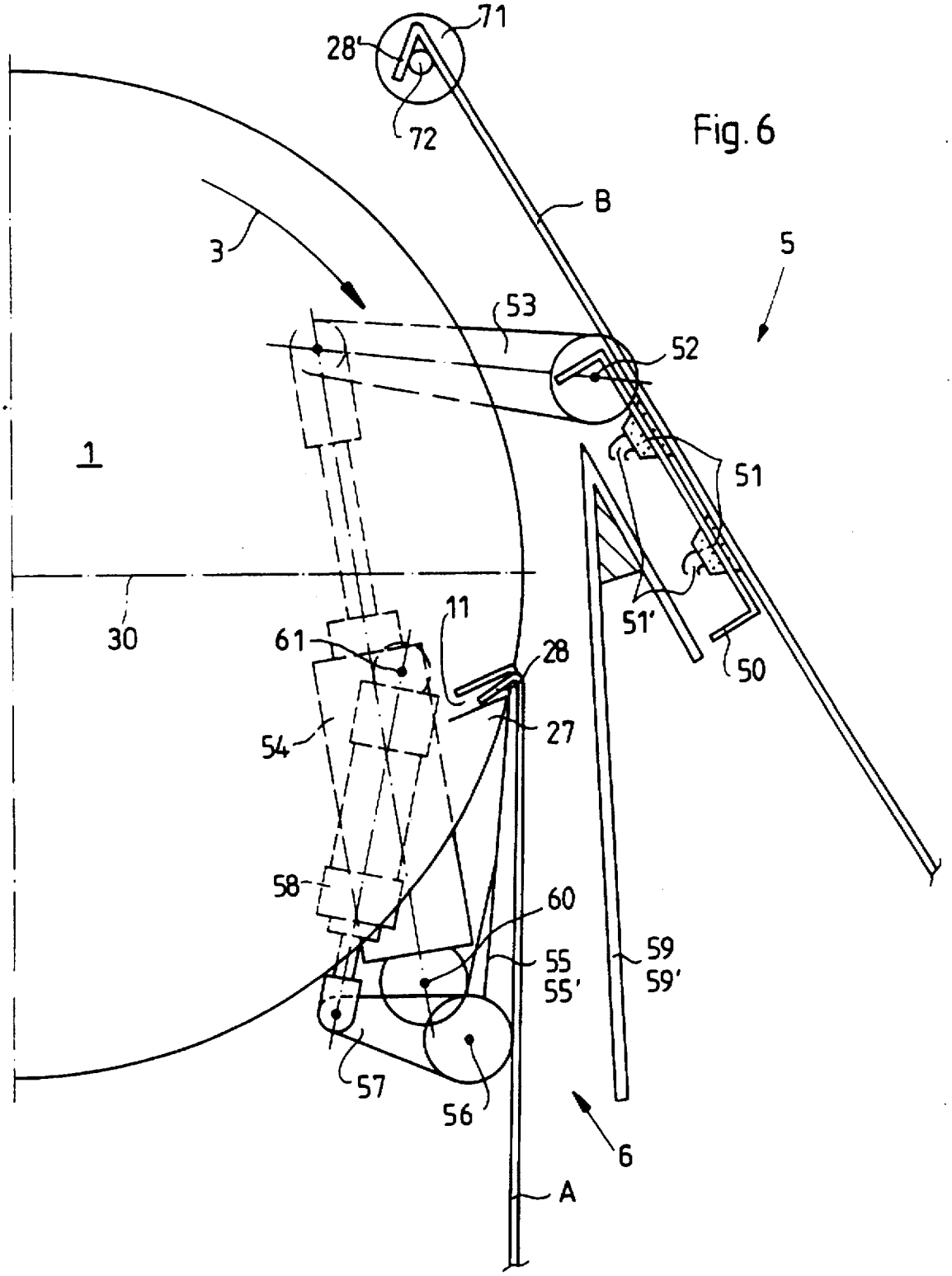
FIG. 6 is an illustration of the removal of the printing plate to be removed out of the cylinder gap of the plate cylinder.

FIG. 6 shows the removal phase of the printing plate A, when the pivot cams 55, 55' lift the printing plate front edge 28 out of the cylinder gap 11 of the plate cylinder 1. Due to the angled shape of the printing plate front edge 28, the printing plate A rests on the pivot cams 55,55' through its own weight. The pivot axis 56, in the position shown in FIG. 6, is in contact with the underside of the printing plate A to provide additional support.

Figure 7:
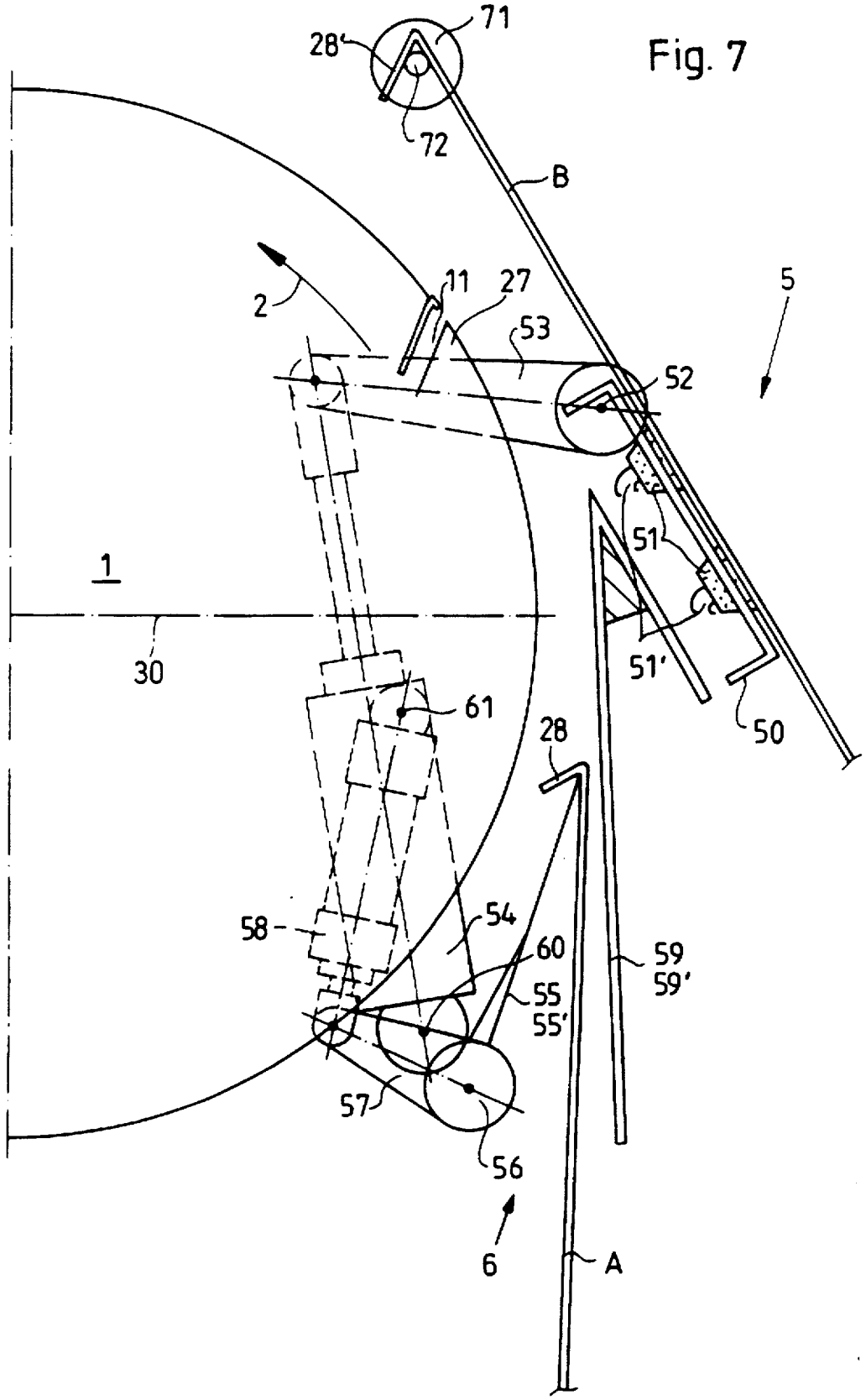
FIG. 7 is an illustration of the removal position of the printing plate A to be removed.

FIG. 7 illustrates how the piston rod of the actuating unit 58 moves, thereby moving the lever 57 around the pivot axis 56. This causes the printing plate A to move in the direction of the printing plate stops 59, 59', so that is it can be removed easily. Thereafter, the direction of rotation of the plate cylinder 1 is changed, so that the plate cylinder 1 now moves in the counter-clockwise direction indicated by arrow 2. Thereby, the cylinder gap 11 in the plate cylinder temporarily holds the front edge 28' of the printing plate B to be fed.

During rotational movement of the plate cylinder 1 in the direction of arrow 2 all elements for fixing the new printing plate B are still at rest.

Figure 8:
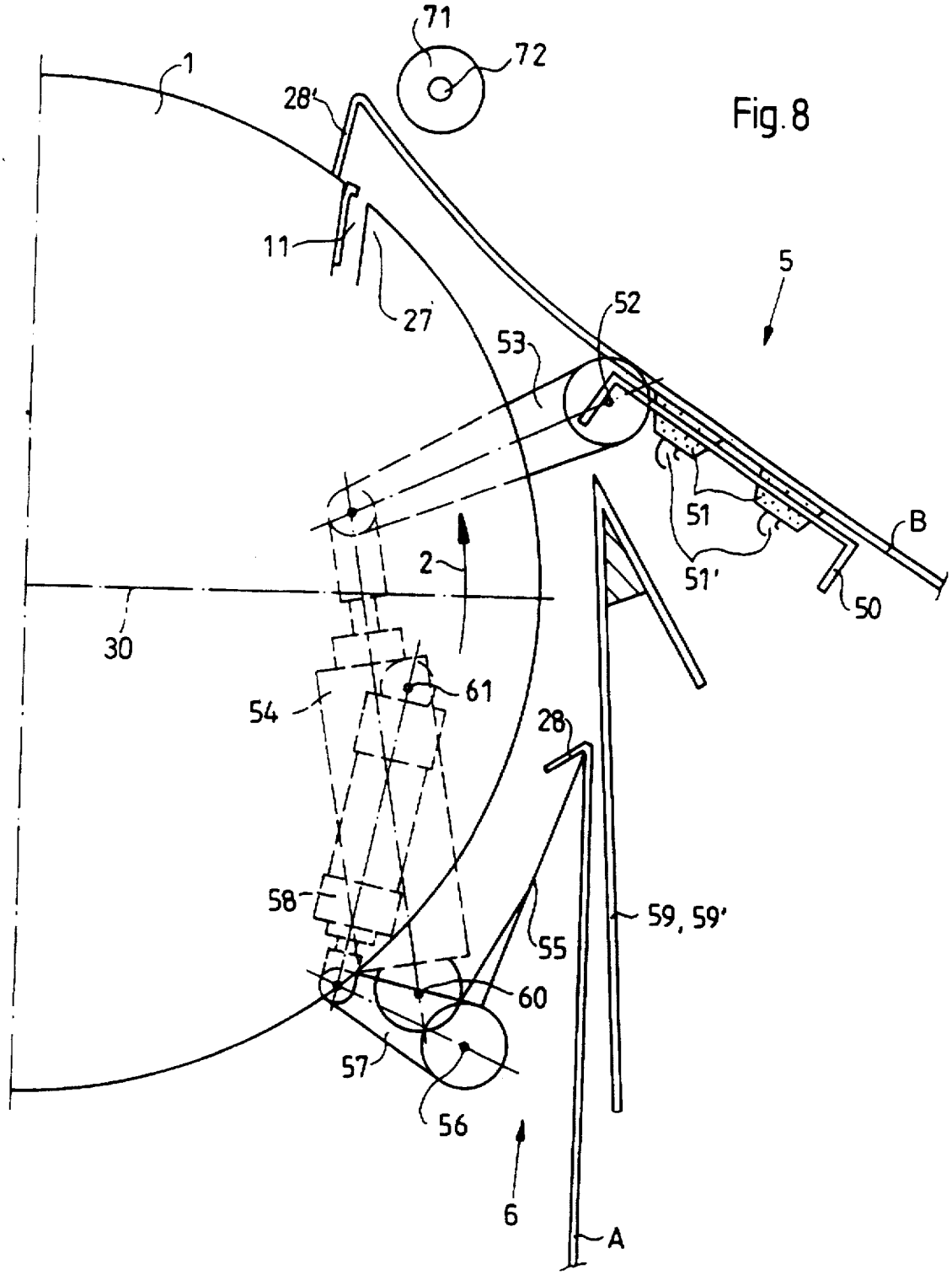
FIG. 8 is an illustration of a new printing plate B fastened to the pivotable support plane as it is brought into contact with the outer cylindrical surface of the plate cylinder.

FIG. 8 shows that a front region of the new printing plate B is in contact with the outer cylindrical surface of the plate cylinder 1. In this state, the pivot cams 55, 55', movable around the pivot axis 56 through the actuating unit 58, are at rest. Immediately before the cylinder gap 11 of the plate cylinder 1 reaches the position illustrated in FIG. 8, the receiving pins 72, 73 which temporarily support the front edge 28' of a new printing plate B are retracted in the horizonal direction, thereby releasing the printing plate front edge 28'. At the same time, the pneumatic holding device 51 which supports the front region of the new printing plate B, are supplied with vacuum through a vacuum system 51'. The front region of the new printing plate B is pressed against the outer cylindrical surface of the plate cylinder 1. Through this close contact of the front region of the new printing plate B with the plate cylinder surface and through the angled shape of the printing plate front edge 28' an engagement force is created and acts on the printing plate front edge 28' which makes it dip into the cylinder gap 11 of the plate cylinder 1 as cylinder gap 11 passes. This engagement force is enhanced when the piston-type actuating unit 54 causes the lever 52 to move around the pivot axis 52, thereby effecting an orientation of the support plane 50 in a direction substantially in parallel with a line tangential to the outer cylindrical surface of the plate cylinder 1. Additionally, the engagement force is increased by the curvature of a region behind the front edge 28' of the printing plate B. It is possible to operate the piston-type actuating unit 54 by electromagnetic, electric, hydraulic or pneumatic devices. By such devices it is possible to have the support plane 50 holding the new printing plate B pivot around the axis 52 exactly at the moment when the cylinder gap 1 is situated opposite the printing plate front edge 28'. With further rotational movement of the plate cylinder 1 at creeping speed in the direction of the arrow 2 the printing plate front edge 28' engages the rim 27 of the cylinder gap 11 of the plate cylinder 1. As the plate cylinder 1 rotates further at creeping speed, the new printing plate B winds itself around the outer cylindrical surface of the plate cylinder 1.

Figure 9:
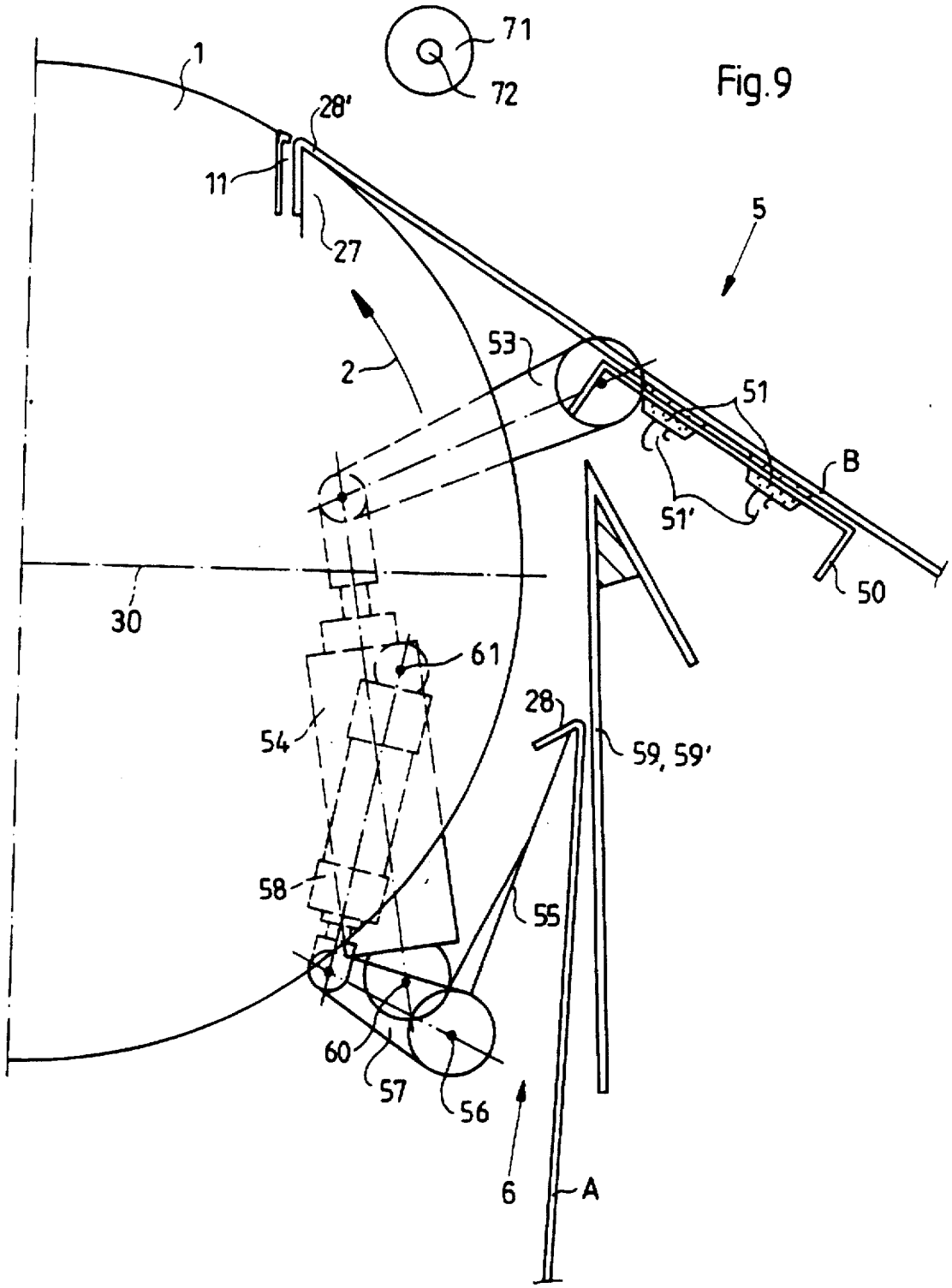
FIG. 9 is an illustration of the new printing plate B as its front edge dips into the cylinder gap of the plate cylinder.

FIG. 9 illustrates further the process of feeding the new printing plate B onto the outer cylindrical surface of the plate cylinder 1. As can be seen, the printing plate front edge 28' now clings to the rim 27 of the cylinder gap 11 which causes the new printing plate B to be positioned tangentially on the outer cylindrical surface of the plate cylinder 1. At this point, the printing plate suspended from the pivot cams 55, 55', may be removed—either manually by sliding or vertical movement or through an automated removal apparatus.

During further rotational movement of the plate cylinder 1 in the counterclockwise direction indicated by arrow 2, the pneumatic holding devices 51 remain under vacuum, so that the new printing plate remains under tension as it is fed onto the outer cylindrical surface of the plate cylinder 1. This ensures uniform mounting of the new printing plate B on the plate cylinder 1. An imperfect seal is created between the pneumatic holding devices 51 and the new printing plate, such that the lateral force on the printing plate caused by wrapping the printing plate around the plate cylinder 1 is greater than the lateral force on the printing plate caused by the pneumatic holding devices 51, while the vertical force on the printing plate continues to hold the printing plate against the pneumatic holding devices 51. The imperfect seal is created by either having a rough contact surface on the pneumatic holding devices 51, or a hole of small diameter in the pneumatic holding devices 51. During the feeding phase of the new printing plate B onto the plate cylinder, the lever 53, the support plane 50 and the piston-type actuating unit 54 remain in the resting position shown in FIG. 9.

Figure 10:
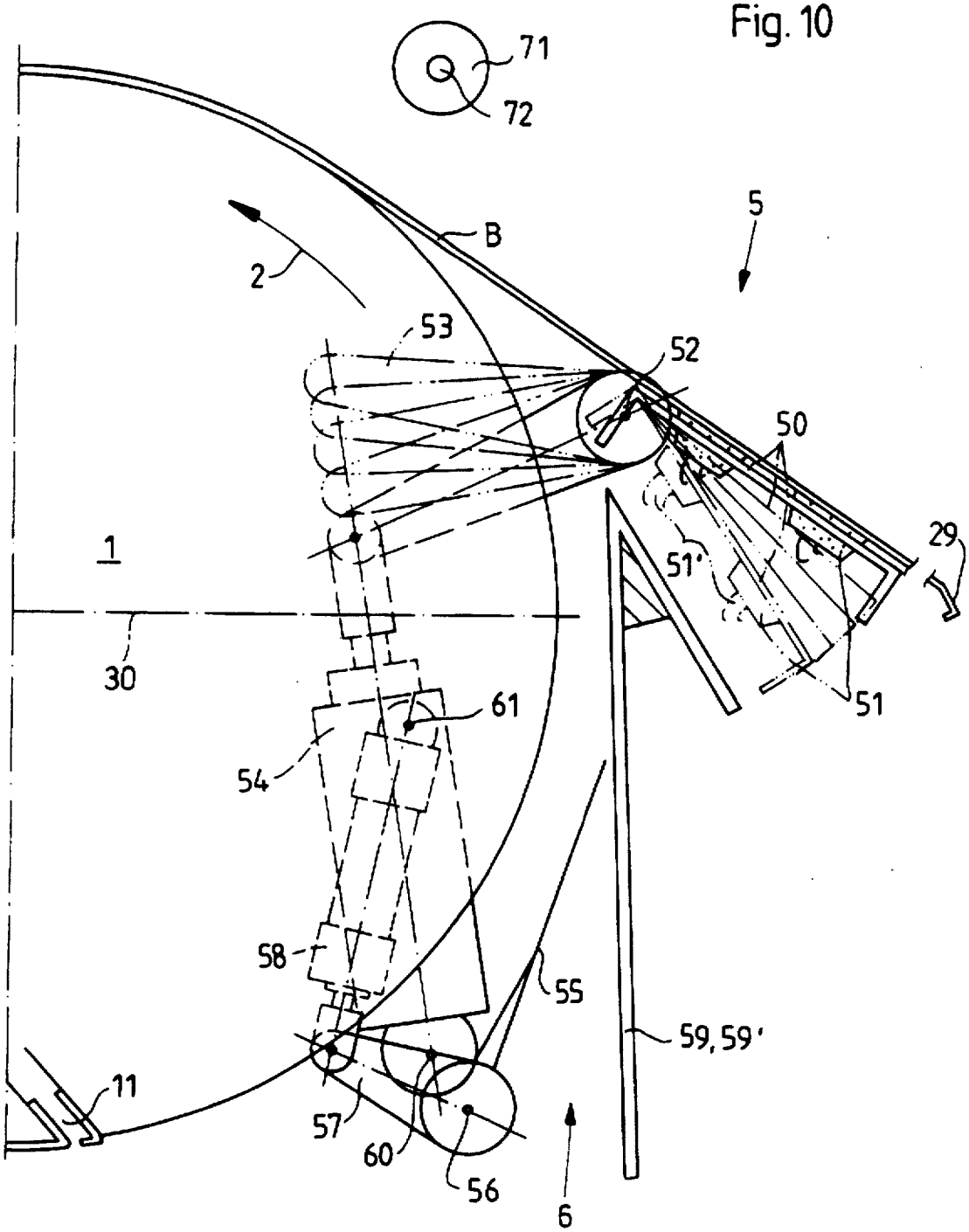
FIG. 10 is an illustration of the position of the pivotable support plane during the feed of the new printing plate B onto the outer cylindrical surface of the plate cylinder.

FIG. 10 illustrates the end phase of the feed of a new printing plate B onto the cylindrical surface of the plate cylinder 1. The plate cylinder 1 has turned an angle of approximately 270° at creeping speed in the counterclockwise direction indicated by arrow 2. The rear edge 29' of the new printing plate B is situated in the line with the pivotable support plane 50 shown in solid lines. At this point in time the vacuum supply 51' is switched off, which causes the pneumatic holding devices 51 to release the rear part of the new printing plate B. The piston rod moves out from the actuating unit 54, whereby the lever 53 is moved around the pivot axis 52, until the lever 53—and therewith the support plane 50—have taken their original positions shown in FIG. 1, as indicated in broken lines. This facilitates the passage of the angled printing plate rear edge 29' over the pivotable support plane 50. By way of a pressure element such as a roller (not shown) cooperating with the outer cylindrical surface of the plate cylinder 1, the printing plate rear edge 29' is inserted into the cylinder gap 11 of the plate cylinder 1 and locked therein by a clamping member.

The printing plate stops 59 and 50' are positioned in such a way that they extend beyond the equatorial plane 30 of the plate cylinder 1. Thereby, it is ensured that after the release of a printing plate A, the rear edge 29 thereof enters the funnel defined by the surface of the printing plate stops 59, 59' and the outer cylindrical surface of the plate cylinder 1 and can safely be received at its front edge 28 by the pivot cams 55, 55'.

We claim:

1. An apparatus for replacing printing plates in a rotary printing press comprising:

at least one plate cylinder receiving both ends of a printing plate, said plate cylinder comprising a clamping device within a cylinder gap in said plate cylinder;

a removal device for removing an old printing plate from said plate cylinder;

an infeed device for feeding a new printing plate to be fastened to said plate cylinder;

an actuating unit; and at least one holding device adjacent said plate cylinder, said holding device orienting a portion of said new printing plate in a direction essentially parallel with a line tangent to an outer cylindrical surface of said plate cylinder, said holding device being pivotable by said actuating unit about a pivot axis from a first position, at which said new printing plate is oriented in said direction essentially parallel with said line tangent to said outer cylindrical surface of said plate cylinder, to a second position, at which a front edge of said new printing plate engages said outer cylindrical surface of said plate cylinder.

2. The apparatus of claim 1, wherein:

said at least one holding device holds said front edge of said new printing plate essentially parallel with said line tangent to said outer cylindrical surface of said plate cylinder, said holding device biasing said new printing plate so that said front edge engages said outer cylindrical surface of said plate cylinder.

3. The apparatus of claim 1, wherein:

said at least one holding device is mounted on a support plane, said support plane being pivotable around said pivot axis.

4. The apparatus of claim 3, wherein:

said pivot axis extends parallel to an axis of rotation of said plate cylinder.

5. The apparatus of claim 3, further comprising:

a plurality of holding devices, and wherein said holding devices are uniformly distributed on said support plane.

6. The apparatus of claim 1, wherein:

said at least one holding device is connected to a vacuum system.

7. The apparatus of claim 3, wherein:

said support plane is pivoted by said actuating unit.

8. The apparatus of claim 1, where in:

said infeed device comprises at least one holding element for temporarily supporting a front edge of said new printing plate.

9. The apparatus of claim 8, wherein:

said infeed device further comprises an actuating unit for moving said at least one holding element.

10. The apparatus of claim 8, further comprising:

a plurality of holding elements, one of said holding elements comprising a stop for aligning said new printing plate with said plate cylinder.

11. A method for replacing printing plates in a rotary printing press comprising the steps of:

removing an old printing plate from a plate cylinder by rotating said plate cylinder in a first direction;

feeding a new printing plate to an infeeding device;

holding said new printing plate with at least one holding device adjacent said plate cylinder;

orienting a front edge of said new printing plate in a direction essentially parallel with a line tangent to an outer cylindrical surface of said plate cylinder;

after said step of orienting, biasing said new printing plate so that said front edge engages said outer cylindrical surface of said plate cylinder said step of biasing comprising pivoting said at least one holding device;

placing said new printing plate on said plate cylinder by rotating said plate cylinder in a second direction opposite said first direction.

12. The method of claim 11, wherein:

said step of holding said new printing plate comprises applying a vacuum to said at least one holding device during said step of biasing said new printing plate and during said step of placing said new printing plate on said plate cylinder.

13. The method of claim 12, further comprising the step of:

pivoting said at least one holding device after a rear edge of said new printing plate has been removed from said at least one holding device.

14. An apparatus for replacing printing plates in a rotary printing press comprising:

at least one plate cylinder receiving both ends of a printing plate, said plate cylinder comprising a clamping device within a cylinder gap in said plate cylinder;

a removal device for removing an old printing plate from said plate cylinder, said removal device comprising at least one stationary stop and at least one pivotable support;

an infeed device for feeding a new printing plate to be fastened to said plate cylinder; and at least one holding device adjacent said plate cylinder, said holding device orienting a portion of said new printing plate in a direction essentially parallel with a line tangent to an outer cylindrical surface of said plate cylinder.

15. The apparatus of claim 14, further comprising:

an actuating unit, said at least one pivotable support being movable by the actuating unit from a position where the printing plate is in contact with said outer cylindrical surface of said plate cylinder and into a position where it is closely adjacent said stationary stop.

16. The apparatus of claim 14, wherein:

said at least one pivotable support is pivoted by an actuating unit operated by a pressurized medium.

17. The apparatus of claim 14, wherein:

a rear edge of said old printing plate abuts said stationary stop during removal of said old printing plate from said plate cylinder.

18. The apparatus of claim 14, wherein:

a side of said stationary stop facing said plate cylinder comprises a friction-reducing material.

19. The apparatus of claim 14, wherein:

an end of said stationary stop is positioned above an equatorial plane of said plate cylinder.

20. The apparatus of claim 16, wherein:

said actuating unit comprises a pneumatically operated piston-cylinder unit.

21. The apparatus of claim 16, wherein:

said actuating unit comprises an electric motor.

22. An apparatus for replacing printing plates in a rotary printing press comprising:

at least one plate cylinder receiving both ends of a printing plate, said plate cylinder comprising a clamping device within a cylinder gap in said plate cylinder;

a removal device for removing an old printing plate from said plate cylinder;

an infeed device for feeding a new printing plate to be fastened to said plate cylinder, said infeed device comprising at least one holding element for temporarily supporting a front edge of said new printing plate, said at least one holding element being movable by an actuating unit in a horizontal direction; and at least one holding device adjacent said plate cylinder, said holding device orienting a portion of said new printing plate in a direction essentially parallel with a line tangent to an outer cylindrical surface of said plate cylinder.

23. An apparatus for replacing printing plates in a rotary printing press comprising:

at least one plate cylinder receiving both ends of a printing plate, said plate cylinder comprising a clamping device within a cylinder gap in said plate cylinder;

a removal device for removing an old printing plate from said plate cylinder;

an infeed device for feeding a new printing plate to be fastened to said plate cylinder, said infeed device comprising at least one holding element for temporarily supporting a front edge of said new printing plate, said at least one holding element comprising a receiving pin; and at least one holding device adjacent said plate cylinder, said holding device orienting a portion of said new printing plate in a direction essentially parallel with a line tangent to an outer cylindrical surface of said plate cylinder.

24. A method for replacing printing plates in a rotary printing press comprising the steps of:

removing an old printing plate from a plate cylinder by rotating said plate cylinder in a first direction, said step of removing comprising the steps of pivoting at least one pivotable support from a position where said at least one pivotable support is in contact with said outer cylindrical surface of said plate cylinder and pivoting said at least one pivotable support into a position where said at least one pivotable support is closely adjacent a stationary stop;

feeding a new printing plate to an infeeding device;

holding said new printing plate with at least one holding device adjacent said plate cylinder;

orienting a portion of said new printing plate in a direction essentially parallel with a line tangent to an outer cylindrical surface of said plate cylinder;

placing said new printing plate on said plate cylinder by rotating said plate cylinder in a second direction opposite said first direction.

25. The method of claim 24, wherein:

during said step of removing an old printing plate, a rear edge of said old printing plate abuts said stationary stop.

* * * * *